US006109403A

United States Patent [19]

Godshaw

[11] Patent Number: 6,109,403

[45] Date of Patent: Aug. 29, 2000

[54] OVERNIGHT CASE CONSTRUCTION

[75] Inventor: Donald E. Godshaw, Evanston, Ill.

[73] Assignee: Travel Caddy Inc., Des Plaines, Ill.

[21] Appl. No.: 09/216,403

[22] Filed: Dec. 18, 1998

[51] Int. Cl.[7] ..... A45C 13/00

[52] U.S. Cl. ..... 190/115; 190/18 A; 190/113; 206/287.1; 206/290

[58] Field of Search ..... 206/290, 289, 206/287.1; 190/115, 113, 112

[56] References Cited

U.S. PATENT DOCUMENTS

| | | | |
|---|---|---|---|
| 1,984,446 | 12/1934 | Wheary | 206/289 |
| 2,362,807 | 11/1944 | Dresner | 206/289 |
| 2,418,589 | 4/1947 | Lifton | 206/289 |
| 2,918,997 | 12/1959 | Kotkins | 190/113 X |
| 3,944,032 | 3/1976 | Samhammer et al. | 190/113 X |
| 4,854,431 | 8/1989 | Pulichino, Jr. et al. | 190/108 |
| 5,054,589 | 10/1991 | Bomes et al. | 190/113 X |
| 5,575,362 | 11/1996 | Franklin et al. | 190/115 |
| 5,732,817 | 3/1998 | Plath | 190/289 X |

*Primary Examiner*—Stephen P. Garbe
*Assistant Examiner*—Tri M. Mai
*Attorney, Agent, or Firm*—Banner & Witcoff, Ltd.

[57] ABSTRACT

An overnight luggage case includes a telescoping handle, a carrying strap, a luggage handle, a front side that folds downwardly and outwardly and an internal extensible flap construction upon which items such as suits and the like may be retained and folded.

3 Claims, 3 Drawing Sheets

10
12
14
36
16
24
18
28
26
32
22
30
20

OVERNIGHT CASE CONSTRUCTION

BACKGROUND OF THE INVENTION

This invention relates to luggage, and more particularly, to an overnight case or bag capable of conveniently holding suits, dresses and the like.

With the advent of increasing airline regulations regarding the size and shape of carry-on baggage, it has become necessary to conform with such regulations by utilizing a case or bag which conforms with those regulations. The sizing of such luggage is, therefore, critical. On the other hand, it is desirable to have adequately sized luggage in order for the luggage to properly carry necessary items packed therein particularly a suit, jacket or dress. A further desire is to have luggage which is easily portable and can be carried, or wheeled, wherein the wheel construction is integrated into the bag. These, among other desires, inspired the development of the present invention.

SUMMARY OF THE INVENTION

In a principal aspect, the present invention comprises soft-sided luggage having a generally rectangular parallelpiped shape with an extensible handle integrated into a back side and wheels on a bottom side. The interior of the luggage is accessible through a front side panel. Within the luggage is a foldable flap which elongates to define a platform for support of clothing. The flap is attached to the interior of the luggage so that it folds inwardly from the bottom side. Hangers may be affixed to a hanger attachment mechanism attached to the inside of the top side of the bag. In this manner, the extensible interior flap may be folded with clothing items that are attached to the hanger mechanism.

Thus, it is an object of the invention to provide improved portable luggage of convenient size which may be used as a carry-on item of luggage for airline travel.

It is a further object of the invention to provide a lightweight, yet portable, item of luggage.

Another object of the invention is to provide an item of luggage which includes wheels and an extendible handle, yet may be easily carried by means of a carry strap or a handle. Another object of the invention is to provide an item of luggage which is designed to hold lengthy clothing items such as suits, dresses and the like and to permit folding of those items in a manner which will preserve their appearance.

These and other objects, advantages and features of the invention will be set forth in a detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
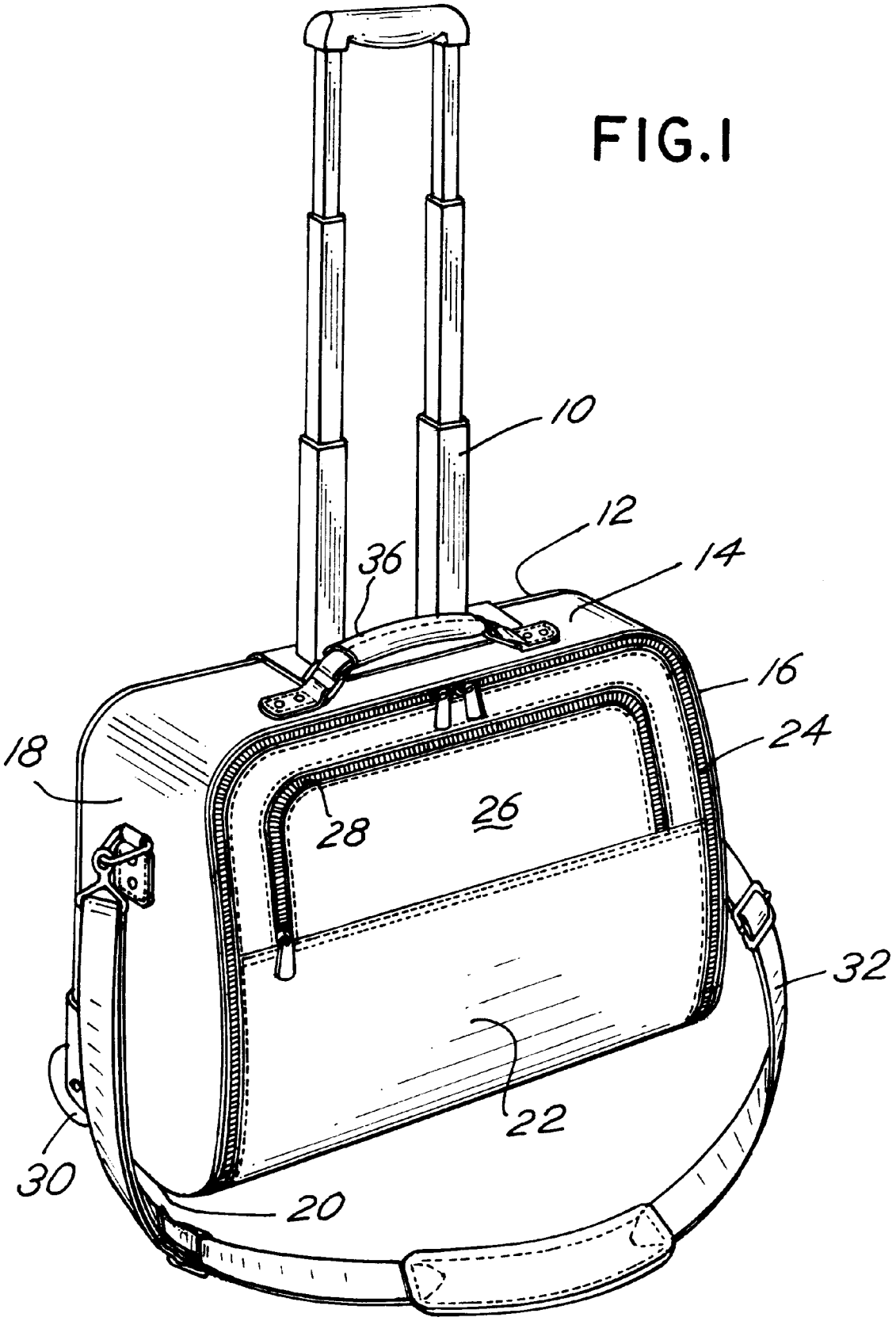
FIG. 1 is an isometric view of the assembled item of luggage of the invention.

The luggage of the invention is typically a soft sided item of luggage which includes a telescoping or extensible handle 10 mounted in a back side 12 of the luggage. The luggage further includes a top side 14, a first lateral side 16, a second lateral side 18, a bottom side 20 and a front panel or side 22. The back side 12, lateral sides 16 and 18, and bottom side 20 are all permanently joined together to define a rectangular enclosure having an open front panel attached by means of a flexible or integrated hinge along one side of the panel. The attachment of the front panel or side 22 is along a line defined by the juncture between the bottom side 20 and the front side 22. A zipper connection or zipper 24 is preferably used to attach and detach the remaining edges of panel 22 to the enclosure defined by the missing lateral and top sides 16, 18, 20. The front side 22 may include an optional outer pocket 26 with a zipper 28.

Wheels 30 are positioned at the juncture of the back side 12 and bottom side 20 and at the opposite ends or comers thereof An optional carrying strap 32 may be attached to the lateral sides 16 and 18 so that when the extensible handle 10 is in its retracted position, the strap 32 may be used to carry the bag or luggage. A handle 36 attached to the top side 14 may also be used to carry the luggage. Typically, the luggage has the shape of a rectangular parallelpiped with dimensions that conform to airline standards for carry-on luggage, e.g., 22 inches by 14 inches by 9 inches maximum.

Figure 2:
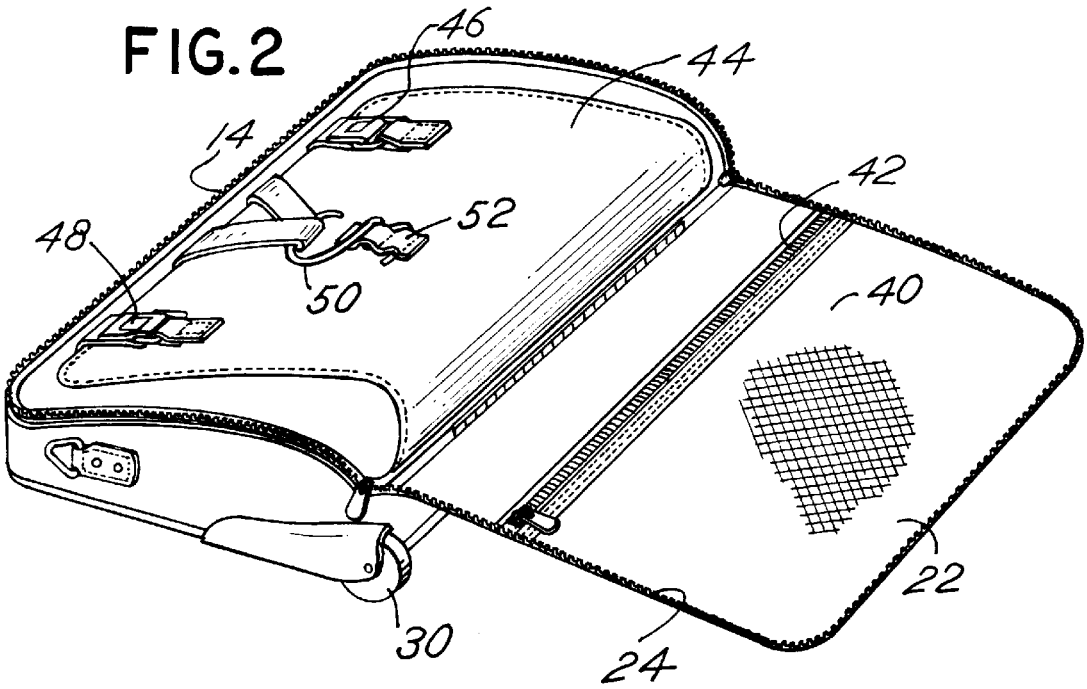
FIG. 2 is an isometric view of the luggage wherein the front side has been opened to expose the interior construction.
Figure 4:
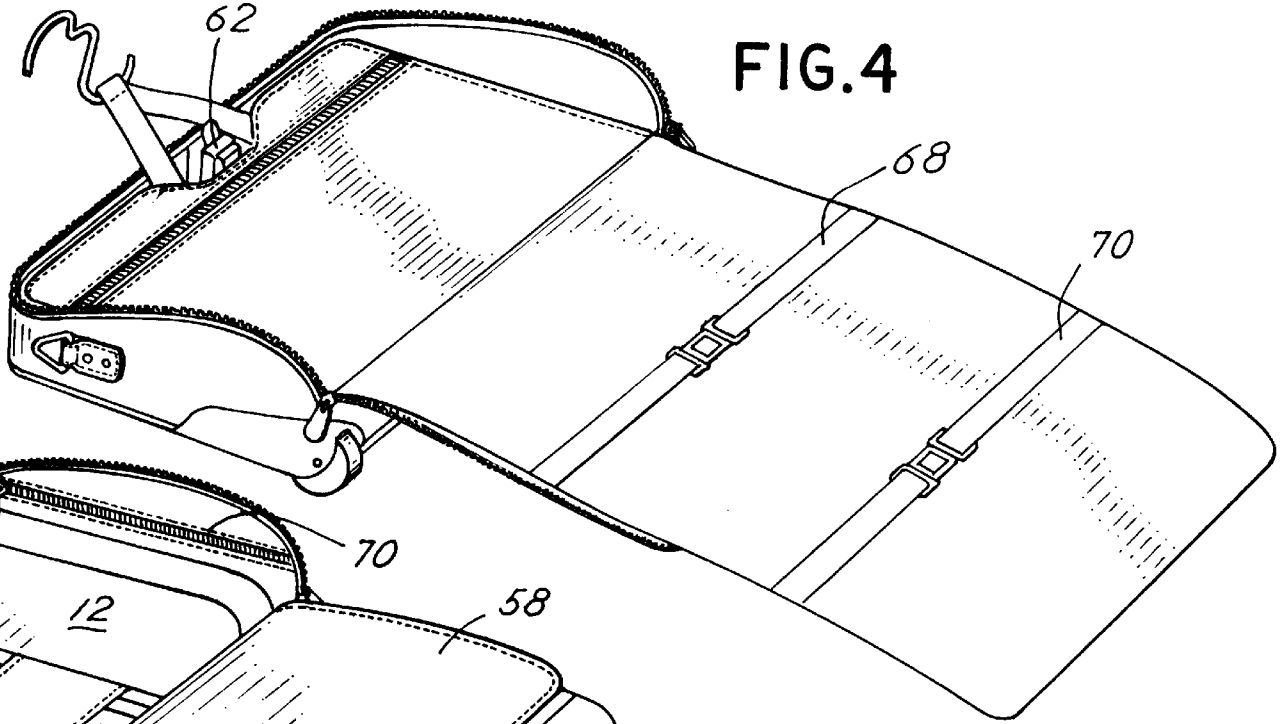
FIG. 4 is an isometric view of a further opening of the interior construction of the luggage.
Figure 5:
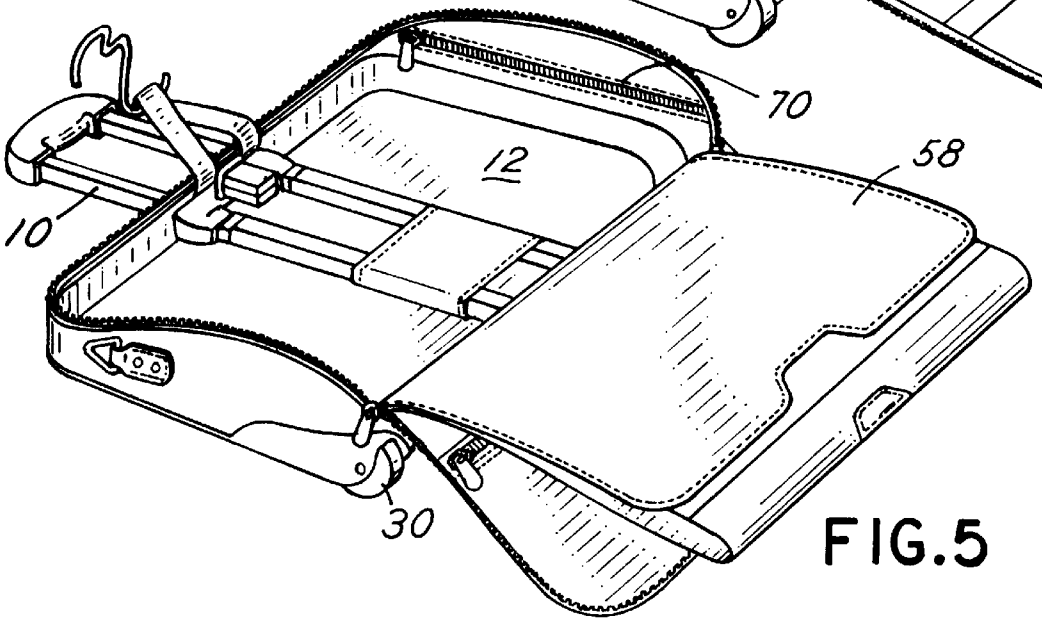
FIG. 5 is an isometric view depicting the full opening of all of the elements forming the interior of the luggage of the invention.

Beginning with FIG. 2 and then continuing on through FIG. 5 of the drawing, it will be noted that the interior construction of the luggage is disclosed. The front side 22 which is attached by means of the zipper 24 is folded out in FIG. 2 and an optional interior pocket 40 is provided which has a zipper 42. An internal, extendible or foldable planar flap 44 depicted in FIGS. 2–5 has a top end removably attached by means of connectors 46 and 48 to the top side 14 on the interior of the luggage. Flap 44 includes a center notch in or adjacent its top edge. Note that a hanger member 50 which is also attached to the inside of the top side 14 is retained on the flap 44 by a fastener 52. Release of the fastener 52 effects release of the hanger 50 to the configuration depicted in FIG. 3. The hanger 50 may be used to hang the entire luggage item from a hanger or on the back of a door, for example.

Figure 3:
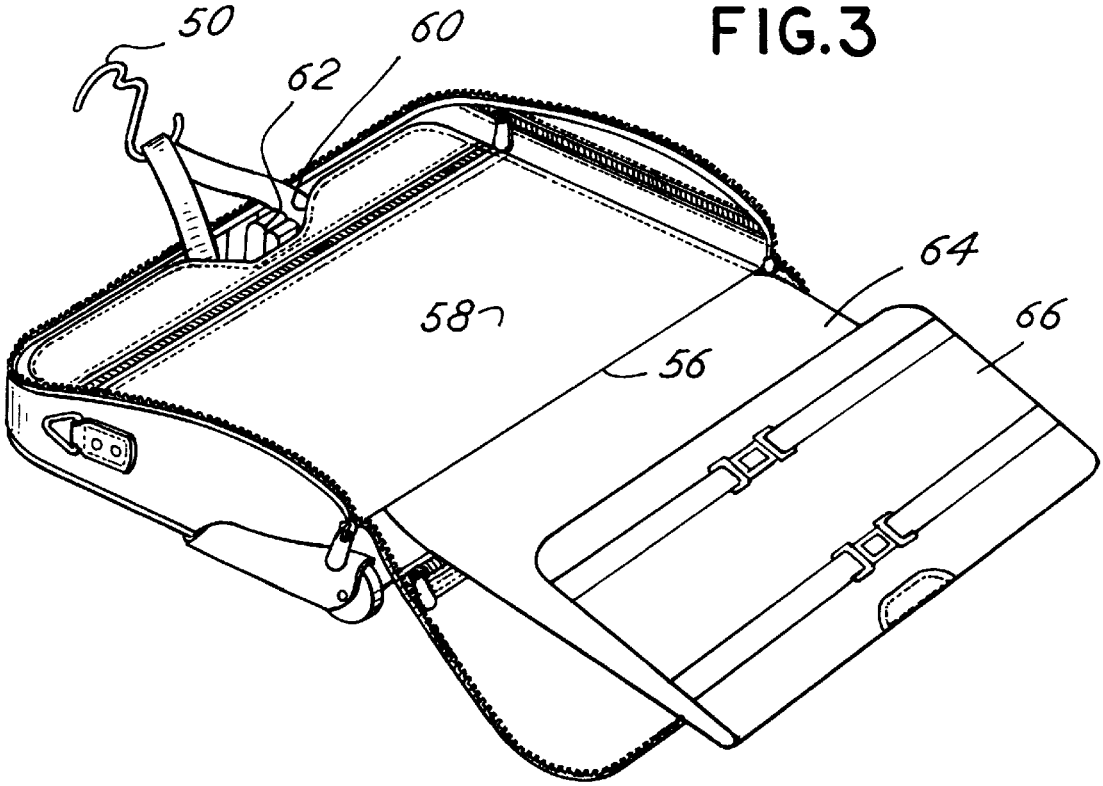
FIG. 3 is an isometric view wherein the interior construction of the luggage is further adjusted for internal exposure of the construction thereof.

As shown in FIG. 3, the flap 44 is joined to the interior of the luggage generally along the junction between the bottom side 20 and the front side 22 at the joining intersection 56. The flap 44 defines a clothing platform and is folded generally into one third sections. In FIGS. 3 and 4, these sections are depicted in their various stages of being unfolded. The flap 44, thus, includes an internal top section or portion 58 which has notch 60 that fits around a centered hanger support mechanism 62 which is attached to the inside of the top 14. The hanger mechanism 62 is designed to engage and hold hangers with items such as suits, dresses and the like within the luggage. The flap 44 then includes a middle extension or section 64 and an end extension or section 66. Clothing straps, such as straps 68 and 70, are provided to hold clothing items on the flap 44. After the items are placed on the strap 44 and a hanger is attached to the hanger mechanism 62, the sections 66, 64 and 58 may be folded to neatly place the clothing items within the luggage.

As shown in FIG. 5, the extensible or telescoping handle 10 fits within the interior of the luggage against the back side 12. When packing the luggage then, toiletries and other smaller items of clothing may be initially positioned against the back side 12. The flap 58 may then be folded in position to cover and protect these items. Then, formal clothing such as suits and dresses may be placed on the extendible flap 44 and the flap 44 may then be folded as previously described. Supplemental zipper pockets such as pocket 70 may be included on the interior of the luggage for example, along one side.

It will be noted that the combination provides for the ease of packing of more formal clothing while at the same time including toiletries and other necessary items in a convenient manner and in a compact fashion in a soft-sided item of luggage. The luggage may also be made in hard-sided, or partially hard-sided configuration. For example, the back side or back panel 12 may be stiff or rigid as may be the lateral sides 16 and 18.

The general configuration of the luggage is a parallelpiped configuration as depicted in the drawings. There may be alternative forms or shapes of the luggage, but the configuration of the luggage will be generally parallelpiped. Thus, while there has been set forth a preferred embodiment of the invention, it is to be understood that the invention is to be limited only by the following claims and equivalents thereof.

What is claimed is:

1. An overnight luggage case comprising, in combination:

a generally rectangular parallelpiped bag having a back side, a top side, a bottom side, and opposite lateral sides, said top side, bottom side and lateral sides connected to define a generally rectangular loop connected to the back side to form an enclosure, open on a front side;

a front side flap joined to the bottom side and releasably attached to the lateral sides and top side to form an enclosed enclosure;

a telescoping handle on the back side having a telescoping extension projectible from the intersection of the top side and the back side;

an internal flap hinged to the bottom side on the inside of the enclosure adjacent the intersection of the top side and the back side;

an internal flap extension connected from the internal flap at the connection thereof to the inside of the enclosure, said internal flap extension foldable over the internal flap for retention within the enclosure;

a hanger attachment mechanism on the inside of the enclosure on the top side thereof intermediate the lateral sides;

said internal flap including a notch for fitting around the hanger attachment mechanism when the internal flap is in a closed position in the enclosure; and a hanger for support of the luggage and its contents, said hanger attached to the inside of the top side for hanging the case when the front side is open;

whereby the internal flap and extension may be folded over one another and the back side and in combination with the hanger attachment mechanism define an extended planar clothes platform cooperative with the hanger attachment mechanism for supporting unfolded items.

2. The luggage of claim 1 including fasteners for attaching the folded flap extension to the top side.

3. The luggage of claim 1 including wheels attached to the corners of the bottom side junction with the back side.

* * * * *